US009765545B1

(12) United States Patent
Petrenko

(10) Patent No.: US 9,765,545 B1
(45) Date of Patent: Sep. 19, 2017

(54) RETRACTABLE SHELTER

(71) Applicant: Ihor Petrenko, Phoenix, AZ (US)

(72) Inventor: Ihor Petrenko, Phoenix, AZ (US)

( * ) Notice: Subject to any disclaimer, the term of this patent is extended or adjusted under 35 U.S.C. 154(b) by 0 days.

(21) Appl. No.: 14/960,404

(22) Filed: Dec. 6, 2015

(51) Int. Cl.

| | |
|---|---|
| ***E04H 15/38*** | (2006.01) |
| ***E04H 6/04*** | (2006.01) |
| ***E04H 15/54*** | (2006.01) |
| ***E04H 15/46*** | (2006.01) |
| ***E04H 6/02*** | (2006.01) |

(52) U.S. Cl.
CPC ..... *E04H 6/04* (2013.01); *E04H 6/025* (2013.01); *E04H 15/38* (2013.01); *E04H 15/46* (2013.01); *E04H 15/54* (2013.01)

(58) Field of Classification Search
CPC ..... E04H 15/36; E04H 15/38; E04H 15/54; E04H 15/46; E04H 6/04
USPC ..... 135/88.13, 88.15, 124, 129, 132–133, 135/136–137, 905, 912; 296/100.18, 296/107.09, 109, 163, 165
See application file for complete search history.

(56) References Cited

U.S. PATENT DOCUMENTS

| | | | | | |
|---|---|---|---|---|---|
| 2,755,811 | A * | 7/1956 | Murray | E04H 6/04 | 135/117 |
| 2,817,344 | A * | 12/1957 | Teeter | E04H 6/04 | 135/117 |
| 3,171,417 | A * | 3/1965 | Stokes | E04H 6/04 | 135/132 |
| 3,688,787 | A * | 9/1972 | Feather | B60J 7/062 | 135/115 |
| 4,262,460 | A * | 4/1981 | Bertin | E04B 1/34373 | 135/123 |
| 4,886,083 | A * | 12/1989 | Gamache | E04H 6/005 | 135/133 |
| 5,740,826 | A * | 4/1998 | Nevin | E04H 15/38 | 135/133 |
| 6,109,283 | A * | 8/2000 | Burke | E04H 3/165 | 135/129 |
| 6,257,260 | B1 * | 7/2001 | Phillips | B62D 33/04 | 135/129 |
| 8,359,994 | B1 * | 1/2013 | Highfield | B63B 19/18 | 114/361 |
| 2008/0210284 | A1 * | 9/2008 | Dubois | E04H 15/52 | 135/129 |

* cited by examiner

*Primary Examiner* — Winnie Yip
(74) *Attorney, Agent, or Firm* — Patent Law & Venture Group; Gene Scott

(57) ABSTRACT

A shelter for an automobile has a pair of tracks positioned on opposing sides of the automobile and rest on a supporting surface such as the floor of a garage or car-port. A plurality of frames each having a u-shaped contour extend on opposing sides and over the automobile and are spaced apart from it. The terminal ends the frames are engaged with trucks which are in rolling engagement with the tracks. A canopy of a flexible material is attached over the frames and is movable between a folded state and an unfolded state when the trucks are moved within the tracks. The tracks have mutually orthogonal roller contact surfaces and the trucks have mutually orthogonal rollers positioned for rolling on the roller contact surfaces of said tracks. The canopy is able to be withdrawn from either of opposing sides and is further able to be drawn over the automobile to the supporting surface at both opposing sides.

2 Claims, 6 Drawing Sheets

RETRACTABLE SHELTER

FIELD OF THE DISCLOSURE

The field of this disclosure is adjustable shelters especially for automobiles and other objects and particularly a shelter that has a manually retractable canopy, supported by frames which are movable along tracks so that the canopy does not touch the object stored within.

BACKGROUND

The prior art discloses a wide range of inventive shelters of the type described in the field of this disclosure. Of particular interest is a retractable motor vehicle shelter described in application publication 2010/0200035 of inventors Jordache et al. This shelter provides opposing parallel tracks in which arched poles move to support a canopy. This device is quite complex and uses a motor for automated actuation. A similar device described in application publication 2012/0048320 may be manual or motor driven and uses cylindrical bases for arched ribs supporting a cover. The bases move within hollows in tracks. One drawback of this approach is that the ribs can easily rub against the sides of the tracks causing wear and generating wear-debris.

Other frame supported tent-like enclosures are known in the prior art, but all of the prior art devices are either too flimsy so as to be subject to breakdown and jamming of moving parts, or too complex so that they are too expensive for broad commercial acceptance and also subject to high maintenance costs due to their large number of moving parts.

In contrast to the prior art apparatus, the presently described and illustrated apparatus is structurally robust and uses a new approach in holding and moving supporting canopy frames so that jamming in tracks is not possible, wear is negligible, and manual operation is easily performed as the covering canopy is opened and closed. Furthermore, the design of the disclosed apparatus is relatively inexpensive to produce making it highly attractive commercially.

SUMMARY

A presently described shelter for automobile or other objects uses a pair of spaced apart tracks which rest on a supporting surface such as the floor of a garage or car-port. A plurality of frames each having a u-shaped contour extend over the automobile but are spaced apart from it. The bottom ends of the frames are engaged with trucks which are in rolling engagement within the tracks. A canopy of a flexible material is attached to the frames and is movable between a folded state and an unfolded state in accordance with movement of the trucks and frames. The tracks have mutually orthogonal roller contact surfaces and the trucks have mutually orthogonal rollers positioned for rolling on the roller contact surfaces of the tracks. The canopy is able to be withdrawn from either of opposing ends of the tracks and is further able to be drawn over the automobile to fully enclose it. Ends of the canopy may be lifted to gain access to the engine or truck compartments of the automobile. The canopy may be drawn back to gain access to the driver and passenger compartments. Although similar devices have been conceived a problem has always been that the frames securing the canopy tend to bind in their tracks. Furthermore, prior art concepts tend to be over-engineered with complex mechanism for moving their canopy and other actuations which makes most prior art devices and apparatus too expensive to produce and too subject to breakdown or failure. The presently described shelter uses novel trucks which are inexpensive to produce and easily operated in a smooth manner.

These and other aspects of embodiments herein described will be better appreciated when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

In this document, the terms "a" or "an" are used, as is common in patent documents, to include one or more than one. Furthermore, the term "or" is used to refer to a nonexclusive "or," such that "A or B" includes "A but not B," "B but not A," and "A and B," unless otherwise indicated.

BRIEF DESCRIPTION OF THE DRAWINGS

Embodiments of the described apparatus are illustrated only as examples in the figures of the accompanying drawing sheets wherein the same reference numeral refers to the same element as it may appear in multiple figures and multiple drawing sheets.

DETAILED DESCRIPTION

As shown in the figures, this disclosure describes a shelter 10 which may be used for sheltering an automobile or other object 20. Shelter 10 may rest on a supporting surface 30 (FIG. 1) which may be a garage floor surface, a car-port surface, or any other reasonably flat surface capable of supporting the weight of shelter 10 and object 20.

Figure 1:
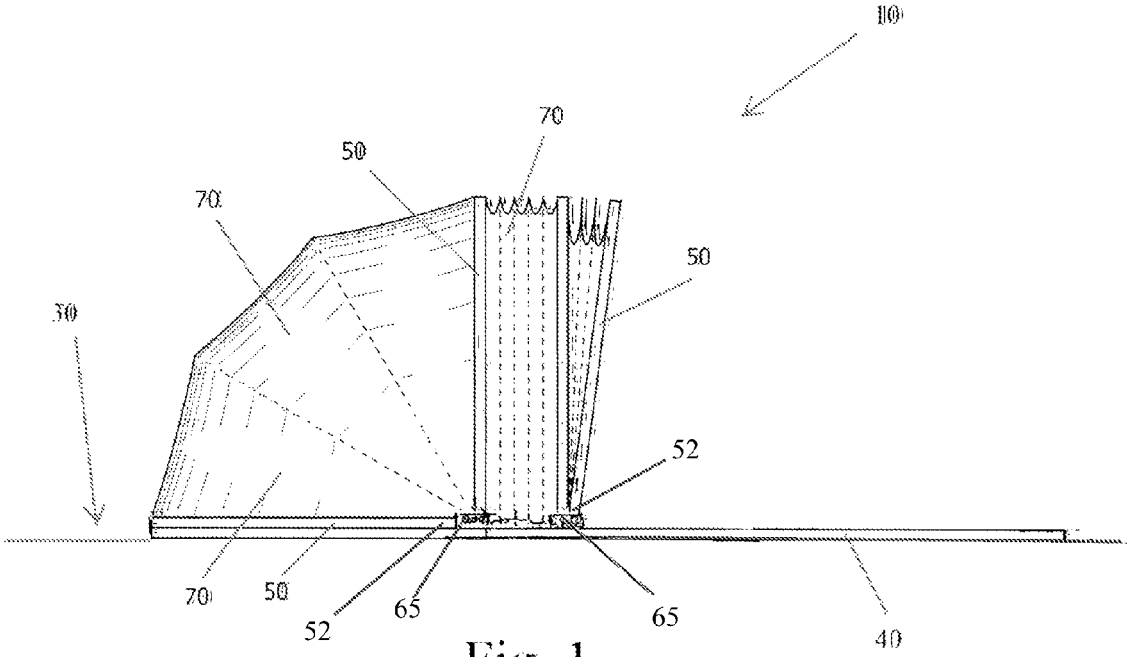
FIG. 1 is a side elevation view of an embodiment of a disclosed shelter showing an open canopy.
Figure 5:
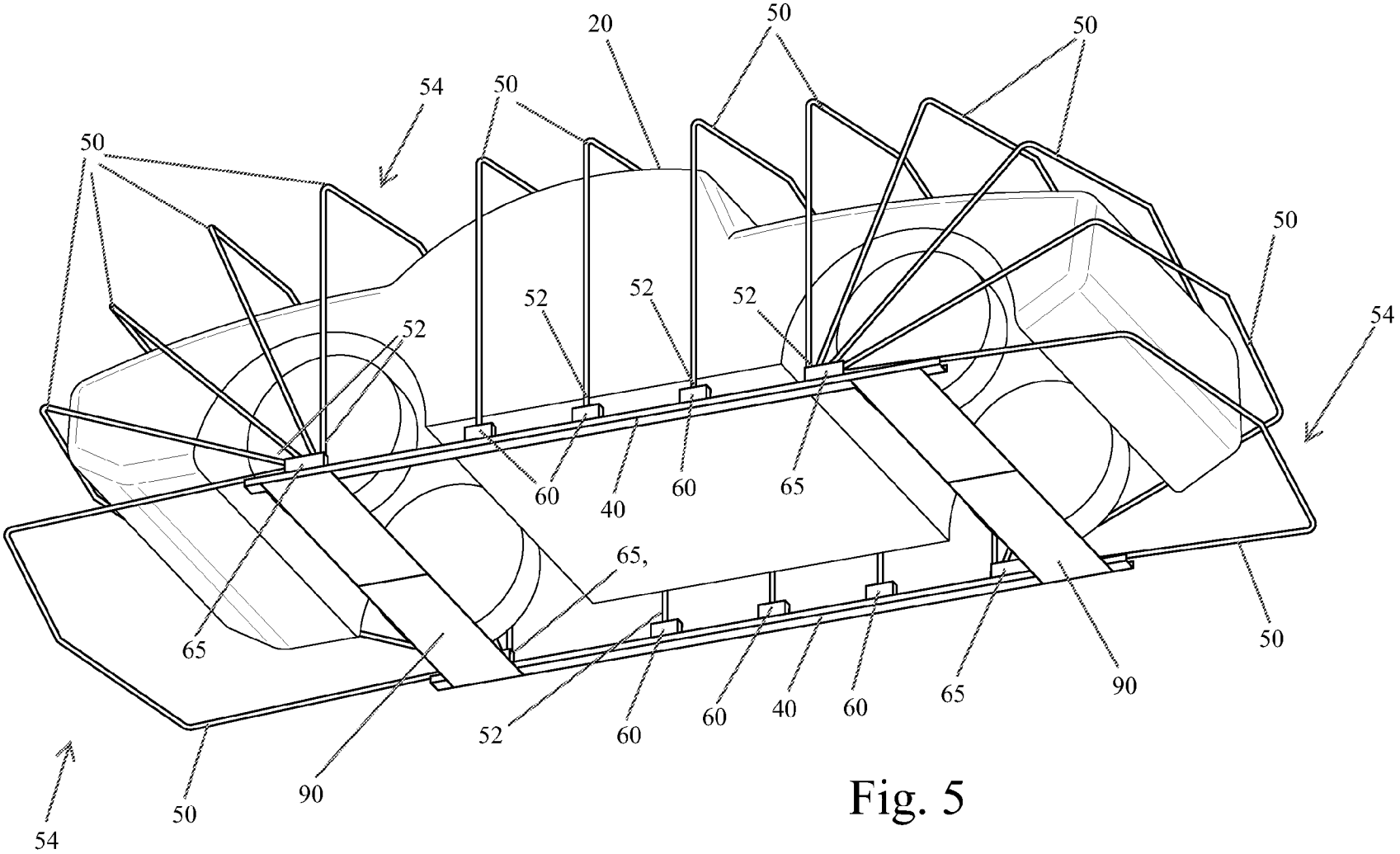
FIG. 5 is a perspective view thereof viewed from below with frames in position to support the canopy (not shown) as in FIG. 4; an automobile is depicted within.

Referring to FIG. 5 it is shown that a pair of tracks 40 are positioned on opposing sides of object 20, and as shown in FIG. 1, tracks 40 rest on surface 30 and may be fastened thereto using common fasteners. A plurality of frames 50 may have a u-shaped contour 54 and may extend over object 20 terminating on opposing sides at tracks 40. Frames 50 may be spaced apart from object 20 as clearly shown in FIG. 5.

Figure 2:
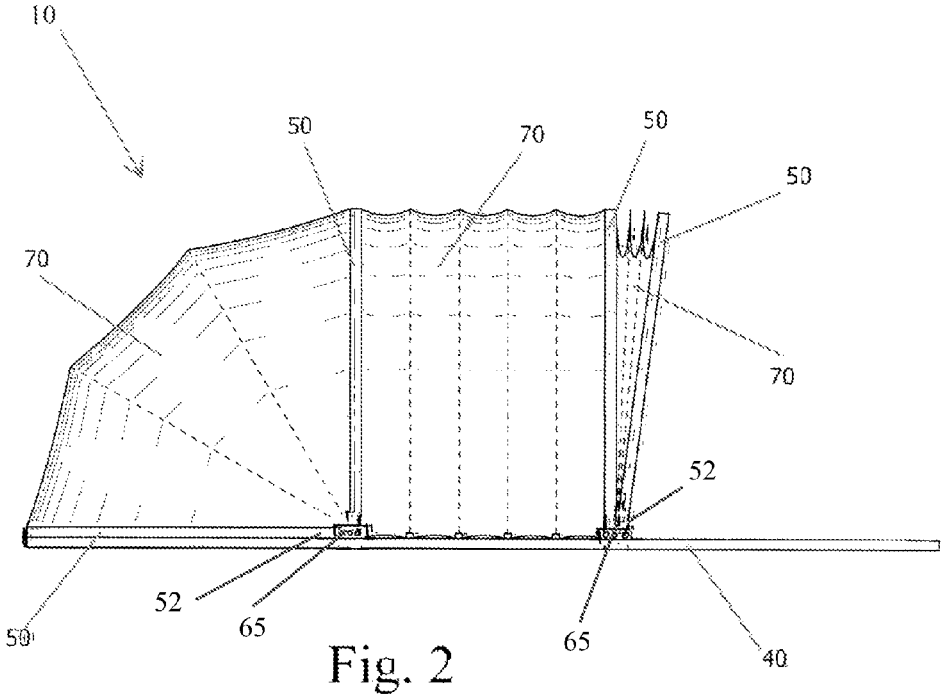
FIG. 2 is a side elevation view thereof with its canopy partially closed.
Figure 3:
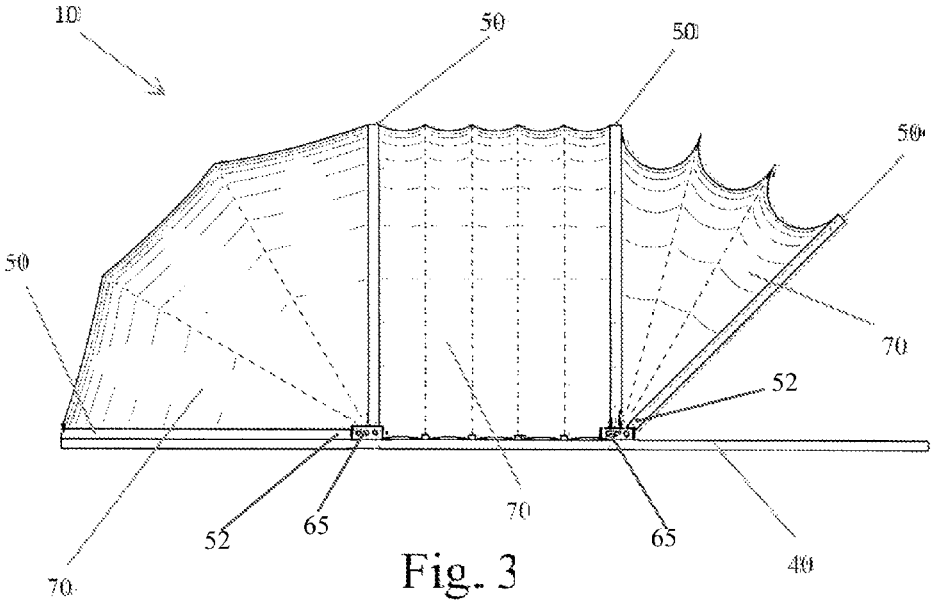
FIG. 3 is a side elevation view thereof shown with its canopy mostly closed.
Figure 4:
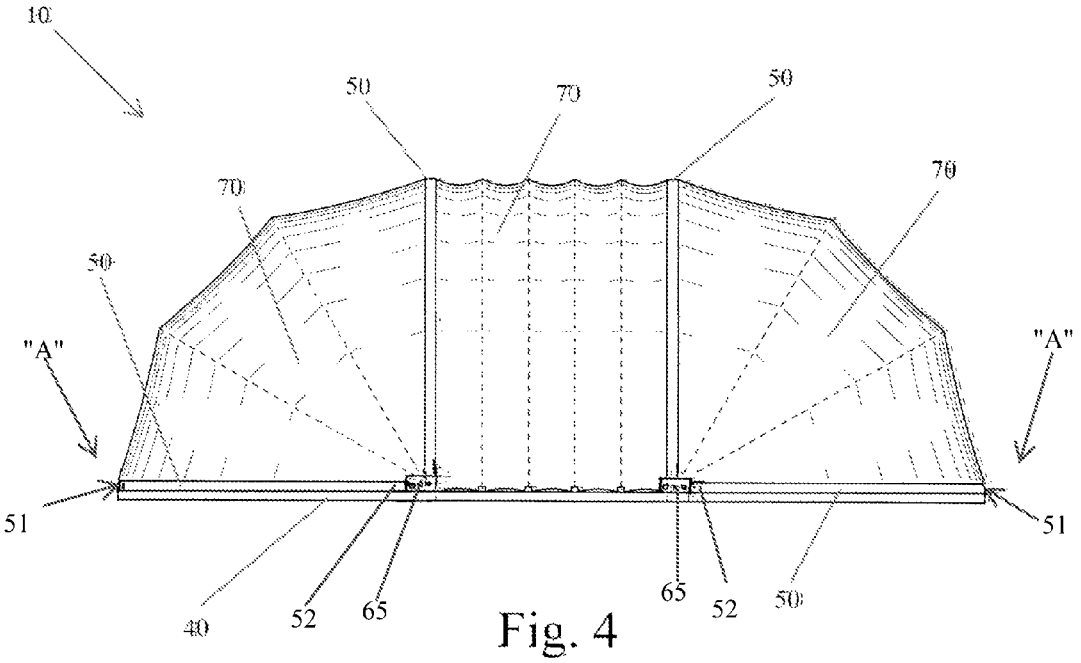
FIG. 4 is a side elevation view thereof shown with its canopy fully closed.

Terminal ends 52 of frames 50 may be engaged with trucks 60 and 65 (FIGS. 8 and 9) wherein trucks 60 and 65 may be engaged with tracks 40 as shown in FIG. 5. Canopy 70 may be of a flexible material such as a canvas fabric and may be attached to frames 50 as shown in FIGS. 1-4, such attachment being by straps of hook and loop material (not shown), or by any other means as known in the art. Canopy 70 together with frames 50 and trucks 60 and 65 may travel between a folded state as shown in FIG. 1, a semi-unfolded state as shown in FIG. 2 and a fully unfolded state as shown in FIGS. 3 and 4. Also, the left side end of canopy 70 (FIG. 1) may be opened to the extent shown in FIG. 2 for the right side end so that only the relatively small extent of canopy 70 shown at the center in FIG. 1 may be left in position over object 20 providing maximal access to object 20. The embodiment shown in FIGS. 1-4 teaches that some of frames 50 may be positioned within canopy 70, at the center, while others may be positioned external to canopy 70 such as shown at the left and right side ends. In a preferred embodiment canopy 70 may fully cover all frames 50 as is clear from FIGS. 1-5. In these figures, some of frames 50 are depicted by dashed lines and the dashed lines at the left and right ends of canopy 70 represent frames external to canopy 70 while the frames represented by dashed lines at the center section of canopy 70 represent frames 50 within and under canopy 70. FIGS. 1-4 are not intended to represent the dimensions of frames 50 such as their cross-sectional width or diameter, but rather only their approximate overall physical size, and as such, frames 50 may be of any crossectional shape, and each one may be one integral piece, or may be made up of several pieces joined together such as is well known with tent poles for instance.

Figure 6:
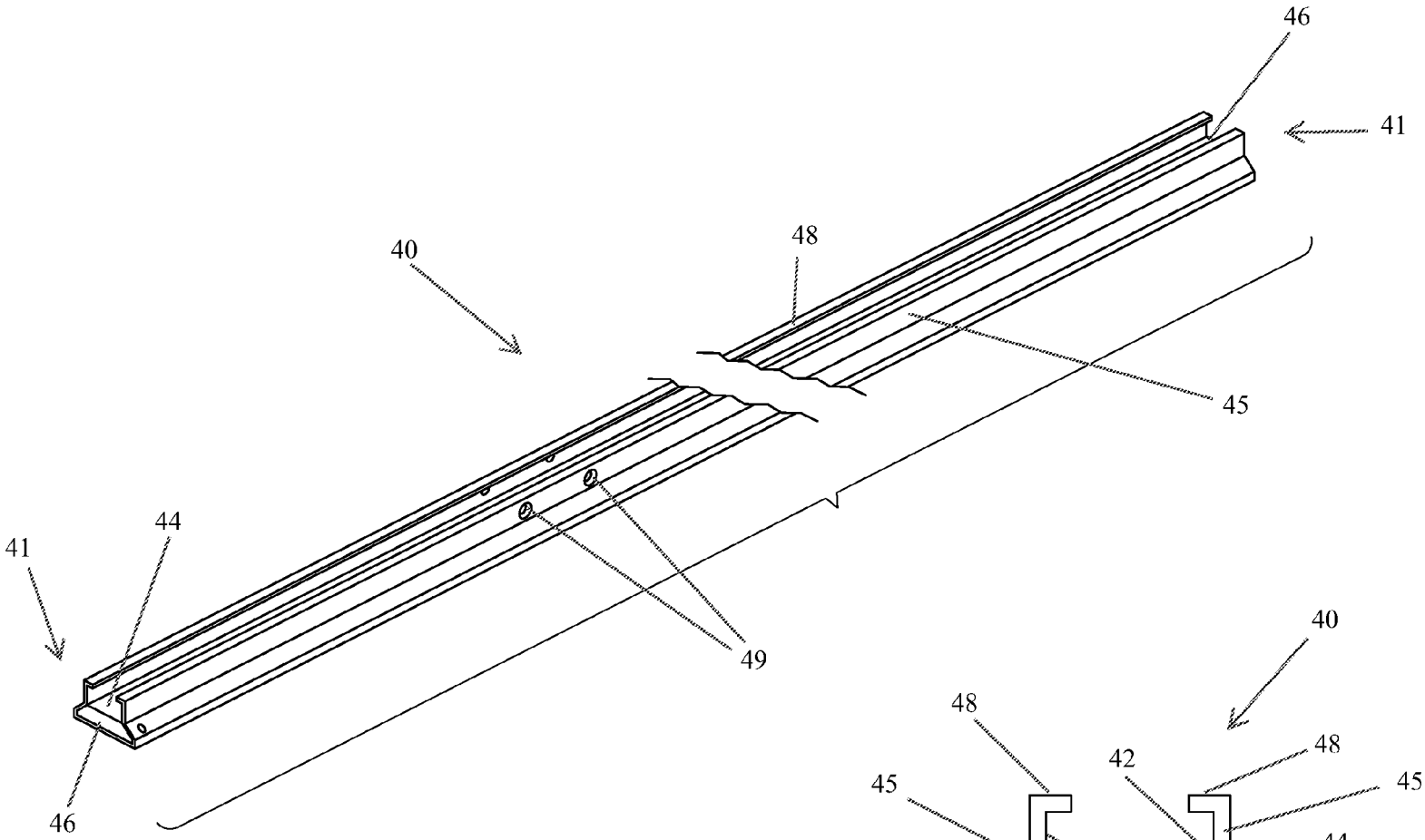
FIG. 6 is a perspective view of a track thereof shown foreshortened.
Figure 7:
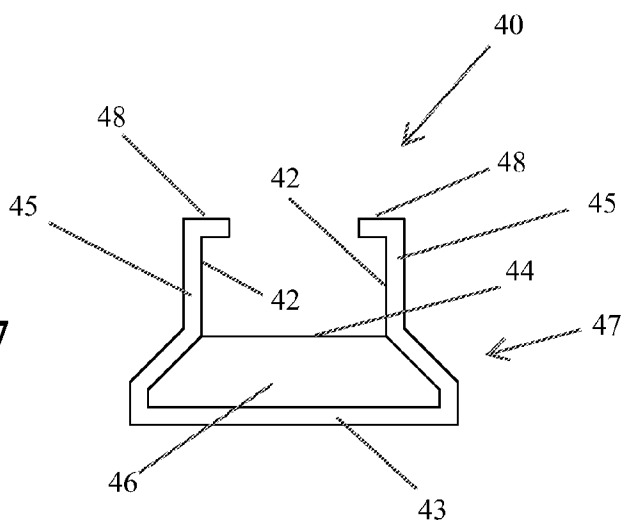
FIG. 7 is an end view of the track of FIG. 6.

Referring to FIGS. 6 and 7 it is shown that in an embodiment, tracks 40 may have a pair of spaced apart longitudinally extensive vertical side walls 45 with opposing interior roller contact surfaces 42 wherein side walls 45 may be joined by a longitudinally extensive horizontal base wall 43. Tracks 40 may be made of extruded steel, aluminum, plastic or other structural materials so that they are longitudinally straight, end-to-end. Tracks 40 may have a trapezoidal base portion 47 as shown. An insert 46 may be placed within track 40 along base portion 47 as shown and may extend its full length as shown in FIG. 6. Track 40 may be made-up of two or more separate pieces laid end-to-end, wherein insert 46 may provide a means for assuring proper joining of the separate pieces. Insert 46 may be shaped as in FIG. 7 so as to fit with friction securement within track 40.

Figure 8:
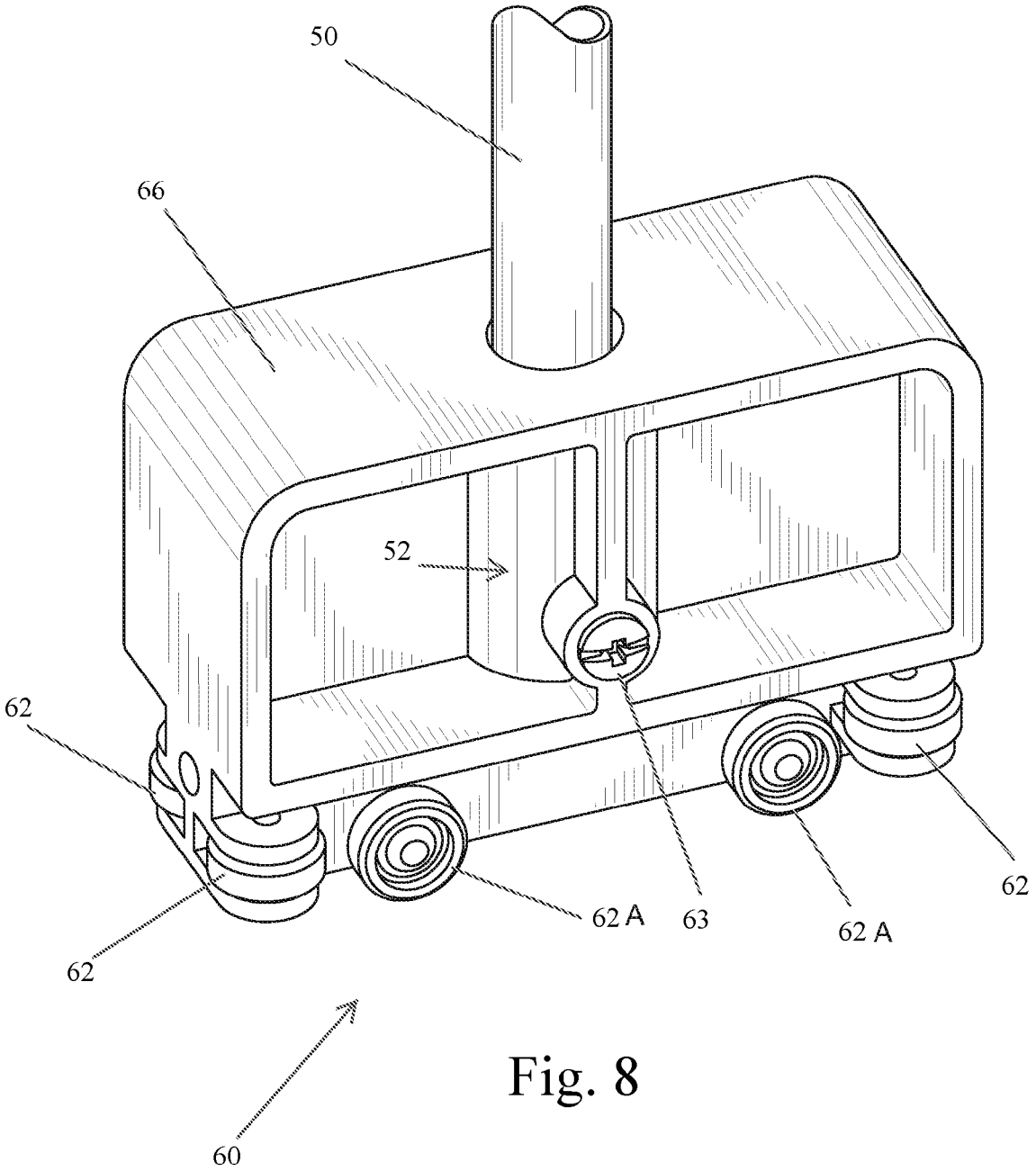
FIG. 8 is a perspective view of a truck of the shelter shown with an end of a frame mounted therein.
Figure 9:
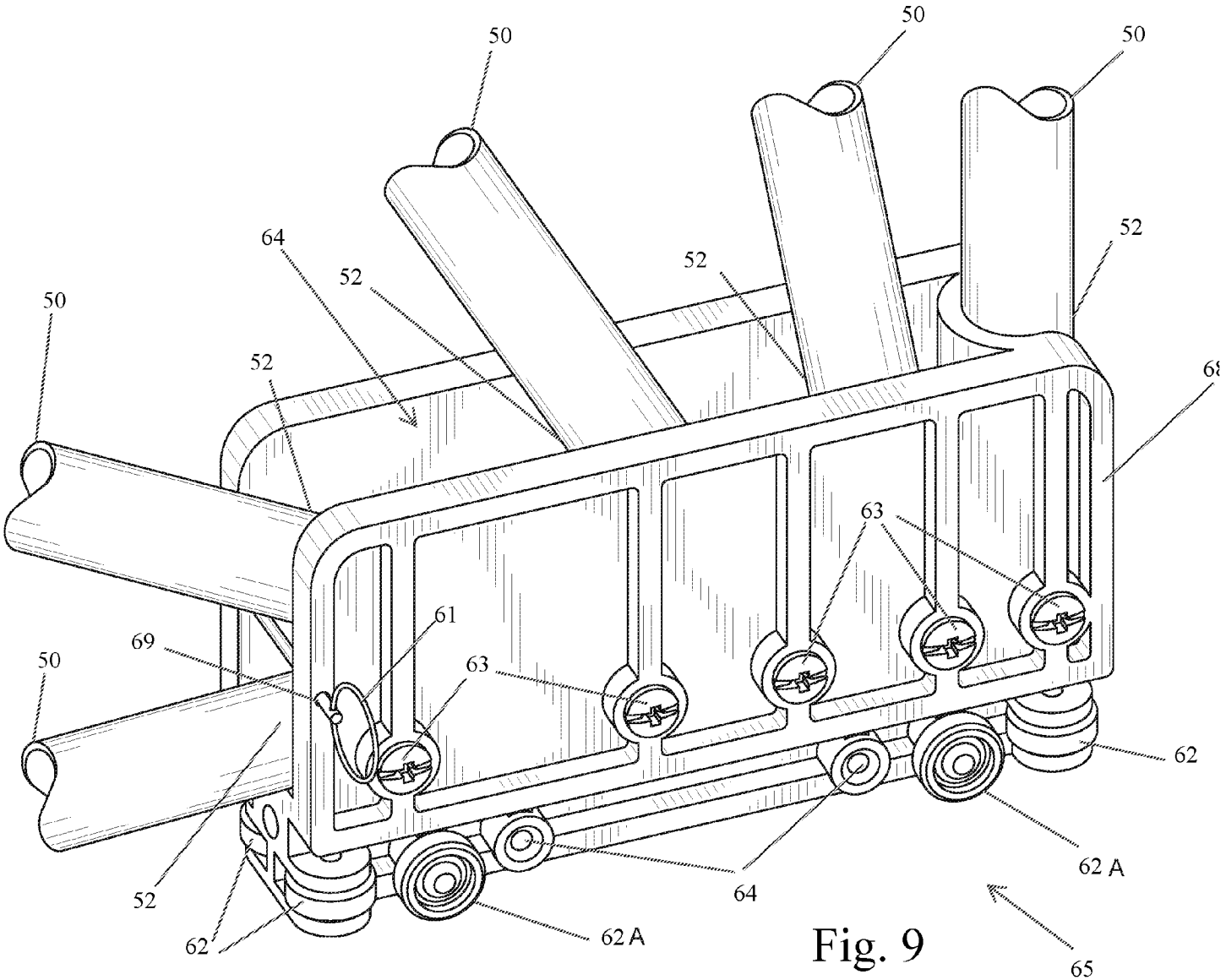
FIG. 9 is a perspective view of a further truck of the shelter shown with ends of a plurality of frames mounted therein.

Trucks 60 and 65, as shown in FIGS. 8 and 9 respectively, may have mutually orthogonal wheels 62 as shown, which may be positioned and oriented for rolling on roller contact surfaces 42 and roller contact surface 44 of insert 46 when a lower portion 61 of trucks 60 or 65 is inserted into tracks 40. Trucks 60 and 65 have rigid bodies 66 and 68 respectively with first wheels 62 being mounted and freely rotating. Bodies 66 and 68 may each have four of first wheels 62 and mutually orthogonal thereto, four second wheels 62A. Of course, more than eight wheels may be used with each truck 60, or 65. First wheels 62 may extend laterally from opposing sides of bodies 66 or 68 so that when trucks 60 and 65 are engaged within tracks 40, first wheels 62 may be positioned in proximity to roller contact surfaces 42 of side walls 45. Therefore, it may be seen that first wheels 62 operate in the vertical space between flanges 48 and surface 44 and a relatively small tolerance may be allowed in this vertical space so that first wheels 62 have space to freely rotate but can prevent trucks 60, 65 from tilting or canting. Furthermore, it can be seen that trucks 60 and 65 can be removed from tracks 40 only at its ends 41 (FIG. 6).

It may be desired to fix trucks 65 at selected positions on track 40, as for instance, so that the top bridging portions 51 of frames 50, when they are laid horizontally, see arrows "A" in FIG. 4, terminate at the end of tracks 40. To accomplish this, holes 49 in tracks 40 may be located longitudinally so that trucks 65 are able to be pinned in place at that location. Trucks 65 have transverse holes 64 which are spaced apart horizontally and located vertically to coincide with holes 49. Pins 61, as for instance of the type shown in FIG. 9, may be used to accomplish securement of trucks 65 in this manner on tracks 40.

As shown in FIG. 9, pin 61 may be placed through holes 69 of body 68 to prevent frame 50 which has been placed into a horizontal attitude, see arrow "A" in FIG. 4, from being lifted or raised by wind forces, for example thereby securing canopy 70 to fully cover object 20. Pin 61 may be removed to allow canopy 70 to be raised, as shown in FIG. 3 in order to gain access to object 20 at one or the other ends of canopy 70. Therefore, when raising or lowering canopy 70 at its ends, trucks 65 may be secured so as to be unable to move on track 40.

Horizontal rollers 62 may be spaced-apart into near contact with both roller contact surfaces 42 so that trucks 60 and 65 are maintained in central positions within tracks 40. Therefore, trucks 60 and 65 are able to easily roll longitudinally within tracks 40. As each pair of trucks 60 or 65 moves within tracks 40 their connected frame 50 moves with them and maintains its vertical posture as shown in FIGS. 1 and 2. The connecting frames 50 move also and are able to maintain their near vertical posture as shown in FIGS. 1 and 2 and, with respect to trucks 65 also are able to rotate away from the vertical as shown in FIGS. 3 and 4. When one truck 60 or 65 is forced to progress along track 40 ahead or behind its laterally positioned truck pair, first wheels 62 tend to resist distortion preventing binding of the trucks with track 40. Because wheels 62A are in contact with surface 44 binding between a truck and track 40 is prevented even when strong distorting forces are applied to frames 50. During normal manual opening and closing of canopy 70 smooth operation is experienced.

As shown in FIG. 5 a compliment of trucks may include pairs of first trucks 60 and pairs of second trucks 65, the pairs engaged with opposing tracks 40. Each pair of first trucks 60 may be engaged with a single one of frames 50 which is fixed in a vertical orientation, see FIG. 8. Each pair of second trucks 65 may be engaged with a frame 50 in a hinged manner as hinge rods 63 extend through the lower portions 52 of frames 50, thereby allowing rotation over a range of angles in the longitudinal direction thereby positioning frames 50 from near vertical to fully horizontal, as shown in FIG. 5. To accomplish this, truck 65 has an open structure referenced by numeral 64.

Tracks 40 may be joined by a transverse element 90 securing tracks 40 in mutually parallel positions as shown in FIG. 5 so that the lower legs of frames 50 on opposing tracks 40 do not converge or diverge as trucks 60 and 65 move along tracks 40. Transverse element 90 may be fastened to tracks 40 using common hardware and may be any rigid element but preferably in the form of a strip, or a rod for instance.

In an embodiment, object 20 may be a vehicle such as an automobile as shown in FIG. 5 wherein frames 50 and canopy 70 are spaced apart from the vehicle so as not to scratch it. Object 20, may be anything that one desires to shelter from dust, sand, dirt, the outdoor elements, and so on, but shelter 10 is ideal for sheltering an automobile as it allows flexibility in gaining access to both ends of canopy 70 and allows nearly full withdrawal as well so as to gain maximum access to sheltered object 20.

In the foregoing description, embodiments are described as a plurality of individual parts, and methods as a plurality of individual steps and this is solely for the sake of illustration. Accordingly, it is contemplated that some additional parts or steps may be added, some parts or steps may be changed or omitted, and the order of the parts or steps may be re-arranged, while maintaining the sense and understanding of the apparatus and methods as claimed.

What is claimed is:

1. A shelter comprising:

a track extensive in a longitudinal direction, said track having a trapezoidal base portion with opposing side walls separated by an open space in a direction lateral to said longitudinal direction, said side walls extensive upwardly from a base wall;

a truck, a lower portion thereof engaged between said side walls, an upper portion thereof extensive above said side walls, said truck movable along said track in said longitudinal direction;

first wheels of said truck spaced apart in said direction lateral to said longitudinal direction and in proximity to said side walls;

a frame pivotally engaged with said truck, said frame rotatable in said longitudinal direction and extending from a center of said track; and a canopy engaged with said frame, said canopy positioned over said track.

2. A shelter comprising:

a track extensive in a longitudinal direction, said track having a trapezoidal base portion with opposing side walls separated by an open space in a direction lateral to said longitudinal direction, said side walls extensive upwardly from a base wall;

a truck, a lower portion thereof engaged between said side walls, an upper portion thereof extensive above said side walls, said truck movable along said track in said longitudinal direction;

first wheels of said truck spaced apart in said direction lateral to said longitudinal direction and in proximity to said side walls;

second wheels of said truck engaged with said base wall;

a frame rigidly engaged with said truck and extending from a center of said track; and a canopy engaged with said frame, said canopy positioned over said track.

* * * * *